US005511771A

United States Patent [19]

Rubscha

[11] Patent Number: 5,511,771

[45] Date of Patent: Apr. 30, 1996

[54] DOCUMENT HANDLER WITH VARIABLE SIZE INPUT TRAY VARYING WITH REGISTRATION

[75] Inventor: Robert F. Rubscha, Fairport, N.Y.

[73] Assignee: Xerox Corporation, Stamford, Conn.

[21] Appl. No.: 333,698

[22] Filed: Nov. 3, 1994

[51] Int. Cl.[6] ..... B65H 5/22

[52] U.S. Cl. ..... 271/4.01; 271/171; 271/207

[58] Field of Search ..... 271/4.01, 171, 271/162, 207, 223, 240, 248, 3.01, 4.08; 400/625, 633

[56] References Cited

U.S. PATENT DOCUMENTS

| | | | |
|---|---|---|---|
| 1,910,971 | 5/1933 | Smith | 400/633 |
| 1,931,514 | 10/1933 | Smith | 400/633 |
| 4,420,149 | 12/1983 | Schultes et al. | 400/625 |
| 4,874,160 | 10/1989 | Yamamoto | 271/171 |
| 5,201,505 | 4/1993 | Shah | 271/3 |
| 5,339,139 | 8/1994 | Fullerton et al. | 355/215 |
| 5,366,216 | 11/1994 | Ahlvin | 271/171 |
| 5,367,370 | 11/1994 | Yoshida et al. | 271/162 |
| 5,377,966 | 1/1995 | Ohmori | 271/4.01 |

FOREIGN PATENT DOCUMENTS

| | | | |
|---|---|---|---|
| 0237026 | 9/1987 | European Pat. Off. | 271/207 |

*Primary Examiner*—H. Grant Skaggs

[57] ABSTRACT

In a document handling system for sequentially feeding document sheets from a stack of document sheets to an imaging station and then to an output, with a document input tray in which stacks of documents of varying sizes may be supportably loaded, and a document output tray for the output, underlying the input tray, and the document input tray has a resettable stack registration side guide system with upstanding opposing document edge guides resetably conformable to the lateral dimensions of the stack of document sheets loaded in the document input tray by movement of at least one the edge guide towards or away from another; the document input tray has a substantially planer document stack supporting tray surface which automatically varies in lateral area upon the resetting of the resettable side guide system so as to substantially reduce the overlying area of the input tray over the output tray for smaller documents loaded into the input tray, and to reduce obstruction of and access to documents in the output tray by the input tray. Preferably, the stack supporting tray surface includes at least one telescoping slide member, and the document edge guide is mounted adjacent to its outer edge to define one side of the document input tray, so that the repositioning of the edge guide correspondingly repositions the telescoping slide member and that side of the input tray.

1 Claim, 6 Drawing Sheets

DOCUMENT HANDLER WITH VARIABLE SIZE INPUT TRAY VARYING WITH REGISTRATION

Disclosed is a document handling system with a variable dimension document input tray system. It is highly desirable for more compact document handlers, especially for more compact copiers or scanners, for the input tray to be located overlying the output tray. In present systems, the upper or overlying document input tray typically obscures the operator's view of, and interferes with operator access to, the underlying document output tray. The disclosed system overcomes these problems with such superposed document sheet input and output trays in a document handler.

In the disclosed system, instead of the upper, overlying, document tray being designed for the maximum size of document sheets to be supported therein, the overlying document tray automatically reduces its size when the operator loads therein a new set of documents to be copied and resets the tray side guides to those document dimensions. i.e., resets the lateral registration of the tray to the stack lateral dimensions. The upper tray dimensions thus automatically shrink for smaller documents when the side guides are reset for those smaller documents, to thereby reduce the obstruction of, and improve the view of, and access to, the underlying tray. This is particularly helpful in the case of jams or other document handler stoppages requiring removal of the underlying document sheets.

By way of background, almost all document input trays have resettable sheet (paper) side guides, comprising upstanding, generally vertical, wall members for holding and maintaining the loaded in document stack and for registering, aligning and guiding the lateral edges of the sheets as they are being fed out of the input tray in the process direction by a sheet separator-feeder. However, in prior such input trays, the side guides move, not the tray itself. That is, the tray bottom or horizontal surface does not normally move with the side guides to reduce the tray size when the side guides are moved towards one another to accommodate smaller documents.

Further by way of background, compact small footprint over-platen document handlers and feeders (the terms are often interchanged in the art) are desirable, and well known. It is desirable for the lateral dimensions of the document handler to not exceed the lateral dimensions of the copier or scanner on which it is mounted. However, many simple document feeders have heretofore had at least one of their trays hanging off and or projecting out from one side of the copier scanner instead. A known solution to this problem is to provide a document feeder in which both the input tray and the output or restacking tray are located one above the other. Both may also be located overlying the platen area of the copier. This is taught, for example, in Xerox Corporation U.S. Pat. Nos. 5,339,139, issued Aug. 16, 1994 to J. K. Fullerton, et al; and 5,201,505 issued Apr. 13, 1993 to N. C. Shah. Said U.S. Pat. No. 5,201,505 even points out and attempts to address the same general problems, as here, although there the output tray is overlying the input tray. The solution there was to provide a semi-transparent and only partially overlying partial shelf. That solution, as indicated there, does not provide full support for a large area of the document sheets. Therefore, this solution would be of questionable suitability for a document feeding input tray, as opposed to an output tray as there. The sagging of a large portion of a stack of documents in an input tray might interfere with proper sequential sheet input feeding or even change the alignment or registration of the stack relative to the front wall or registration edge from which the sheets are being fed. That problem is noted directly in said U.S. Pat. No. 5,201,505 in Col. 2, lines 19–27.

Although not essential, it is also well-known for tray side guides to be connected to, or positioned to actuate, positional sensors, so as to indicate (to the controller for the document handler or reproduction machine) the lateral dimension of the documents being loaded by reference to the side guide width setting indicated by those sensors. This feature may also be compatibly provided with the present system, as disclosed in the examples.

More specifically, there is disclosed in the specific exemplary embodiment herein a document handling system for sequentially feeding document sheets from a stack of document sheets to an imaging station, and then from the imaging station to an output, said document handling system having a document input tray in which said stacks of documents of varying sizes may be supportably loaded for said feeding, and a document output tray for said output, with said input tray overlying said output tray, and said document input tray having a resettable stack registration side guide system with upstanding opposing document edge guides resetably conformable to the lateral dimensions of said stack of document sheets loaded in said document input tray by movement of at least one said edge guide towards or away from another; wherein said document input tray further comprises a substantially planer document stack supporting tray surface which automatically varies in lateral area upon said resetting of said resettable side guide system to conform to the lateral dimensions of said stack of documents loaded in said document input tray so as to substantially reduce the overlying area of said input tray over said output tray for smaller documents loaded into said input tray and reduce obstruction of and access to documents in said output tray by said input tray.

Further disclosed features of the exemplary embodiment herein include, individually or in combination, those wherein said document input tray stack supporting tray surface has opposing outer lateral edges, and at least one said outer lateral edge automatically moves toward said other outer lateral edge as said document edge guides are moved towards one another; and or wherein said stack supporting tray surface comprises at least one telescoping slide member, and at least one said document edge guide is mounted adjacent to the outer edge of said telescoping slide member to define one side of said document input tray, and said repositioning of said document edge guide correspondingly repositions said telescoping slide member and said one side of said document input tray; and/or wherein the opposite lateral sides of said document input tray are defined by opposing telescoping slide members forming a substantial part of said variable area stack supporting tray surface, and one said document edge guide is mounted to the outer edge of each said telescoping slide member.

As to specific hardware components of the subject apparatus, or alternatives therefor, it will be appreciated that, as is normally the case, some such specific hardware components are known per se in other apparatus or applications which may be additionally or alternatively used herein, including those from art cited herein. All references cited in this specification, and their references, are incorporated by reference herein where appropriate for appropriate teachings of additional or alternative details, features, and/or technical background.

Various of the above-mentioned and further features and advantages will be apparent from the specific apparatus and its operation described in the examples below, as well as the claims. Thus, the present invention will be better understood from this description, including the drawing figures (approximately to scale) wherein:

Figure 1:
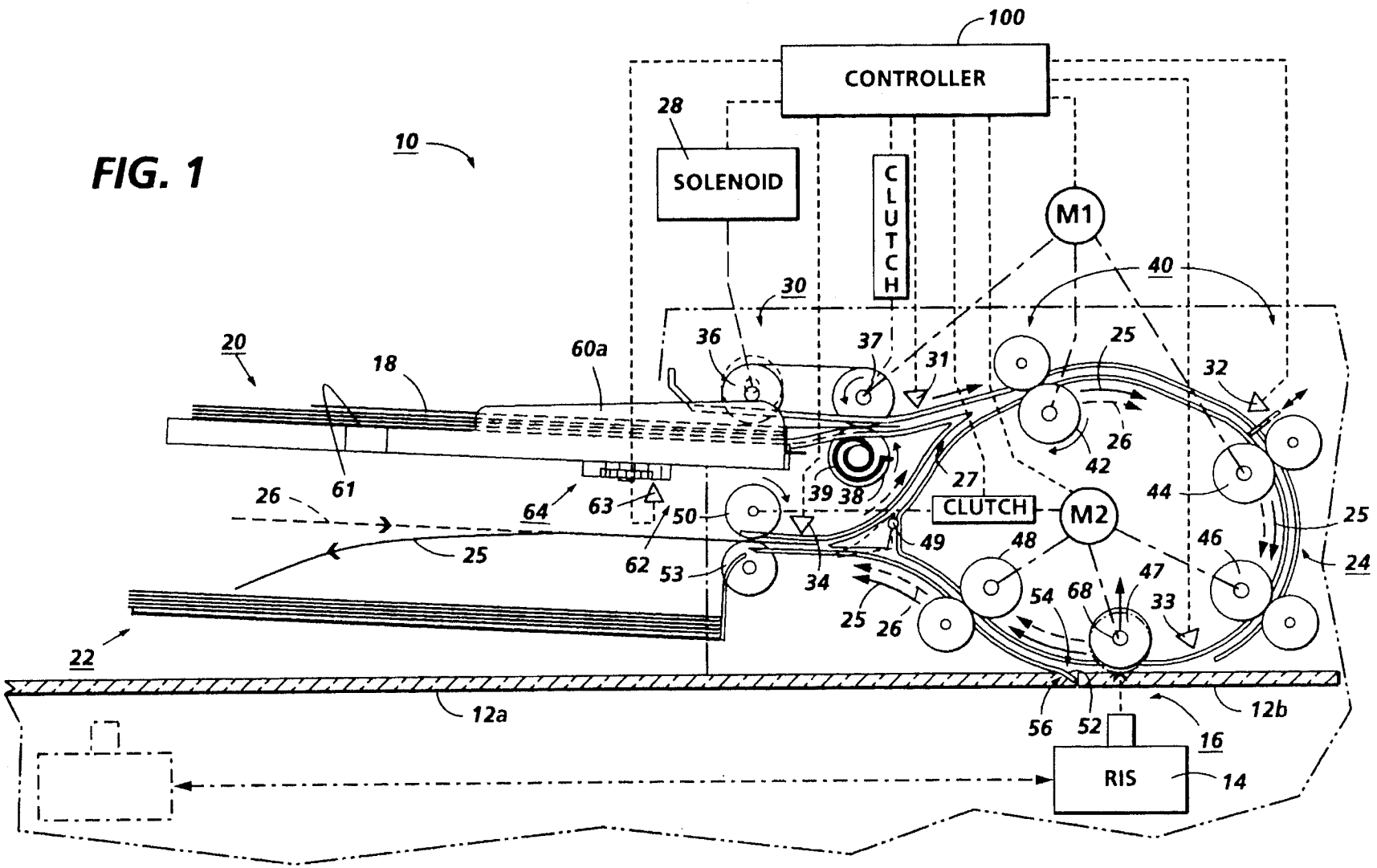
FIG. 1 is a partially schematic front view of one embodiment of an exemplary compact document handling system incorporating one example of the subject variable dimension document input tray system.

Describing now in further detail the exemplary embodiments with reference to the Figures, there is shown in FIG. 1 an exemplary document handler 10 in which an example of the subject variable input tray 20 system may be utilized. This document handler 10 will be described first. As noted, this is further described in the above-cited U.S. Pat. No. 5,339,139. It has a desirable small loop document path. It also provides "immediate" type duplex document inversion with the duplex sheet inverter chute path located over the top of the stack in the return or exit tray and under the input tray. This highly compact and lightweight document handler 10 may be a part of an optional or add-on top module of a convertible digital copier/scanner unit (not fully shown). A platen 12 is provided with a large platen portion 12*a*, which may be scanned by a rastor input scanner or RIS 14, also part of the module. The exemplary RIS 14 here may be, e.g., a diode type full width array of a conventional type for high resolution, scanning closely under the platen. The entire scanner or input module, including the platen 12 and the RIS 14 desirably may be a removable top module so that the underlying processor or printer unit may alternatively be used as a stand alone or remote digital printer for remote electronic input. With the top module, including the document handler 10 mounted on the digital printer unit, the integrated unit provides a fully integrated convenience copier which even a casual operator may use simply by placing documents 18 in the document input tray 20 and automatically copying them at an imaging station 16 as if this were a normal light lens copier rather than a digital copier. Alternatively, the same document input at imaging station 16 (or platen portion 12*a*) provided here may also be easily used for facsimile transmissions. In that case the documents 18 will be similarly electronic imaged by RIS 14, but then transmitted over telephone lines or any other communications media, with or without electronic storage or buffering. Only the relevant portions of the digital copier top module and its document handler 10 need be illustrated here since the digital printer or copy processor on which it may be mounted may be any of various known, conventional, or new electronic printer units, which do not per se form part of this invention, and therefore need not be described.

The same RIS 14 in this example may be utilized for scanning documents manually placed on the platen portion 12*a* as well as documents which are automatically fed to be imaged on platen portion 12*b* by the document handler 10. This is provided here by a two part platen 12 comprising a full size scanning platen portion 12*a* and a narrow slit scanning portion 12*b*. As may be seen, these two platen portions 12*a* and 12*b* are preferably closely adjacent one another and in the same plane and utilize the same frame mounting and/or alignment system. The two document trays 20, 22 may thus also primarily overlay the platen portion 12a rather than extend the machine footprint.

In the disclosed CVT system, including a driven over-platen roller 47, all three document feeding rollers, 46, 47 and 48 may be commonly driven by the same motor, such as servo motor M2, at the same speed, while the document is being imaged. The document handler 10 feeds documents to be imaged at a constant velocity with this CVT system past a scanning or slit image station 16 which is at the slit scanning platen portion 12*b*, as shown. For this document handler 10 document imaging, the RIS 14 is "parked" at this imaging station 16.

Documents 18 may be loaded face up in normal order in the document input tray 20 of the document handler 10 when automatic document input is desired. The stack of documents is then sequentially fed from the input tray 20 through a short, highly compact, "U" shaped document path 24 for imaging at the imaging station 16, and then after one imaging the simplex documents are fed directly on to a document output tray 22 in which the documents are restacked face down. However, as will be described, there is a partial difference in the document paths provided for simplex documents as compared to duplex documents. This is illustrated here by solid arrows representing the simplex document path 25 and dashed line arrows representing the duplex path 26. Note, however, that both simplex and duplex documents are ejected and restacked in the same document output tray 22 here, in the same manner, after their copying is completed.

The document input tray 20 here is closely superimposed above the document output tray 22. That is, these two trays closely overlay one another to form a relatively enclosed space between the two trays. Yet, both trays are readily operator accessible. This space between the two trays 20 and 22 here provides a protective and space saving inverter chute for duplex documents which are being inverted between the copying of their first and second sides.

Note that the U-shaped document path 24 contains a single natural inversion for turning each document sheet over once between its infeeding from input tray 20 and the imaging station 16.

All of the document sheet feeding in the document path 24, including the duplex document path 27 portions, is provided in this example by only two servo drive motors, M1 and M2, respectively connected to the various document path sheet feeders as illustrated by dashed lines. Both of the drive motors M1 and M2, all solenoids and clutches, are controlled by a controller 100, which may be of the type known in the prior art previously noted above. Also connecting with the controller 100 in a conventional manner are sheet path sensors for detecting the lead and/or trail edge of document sheets being fed through the document path 24, 27 such as the illustrated sensors 31, 32, 33, and 34.

A solenoid 28 is connected to that portion of an exemplary top sheet separator/feeder 30 which sequentially feeds the top sheet of the stack of documents loaded in the input tray 20 into the document path 24, and separates each fed sheet from the respective underlying sheets. The sheet separator/feeder 30 may be driven by the motor M1, as shown. A nudger roll 36 is lowered by solenoid 28 onto the top of the stack for feeding or advancing the top sheet or sheets 18 into a positive retard separating nip, comprising a driven first feed roll 37 and an undriven retard roll 38.

Once a top sheet has been separated and fed into the document path 24 as described above, it then enters the regular document path sheet drive system 40. This will be described here with reference to the driven rollers, although the mating and nip-defining idler rollers are also illustrated. As shown, these document path sheet drive rollers of this example comprise, in order: second or take-away rolls 42, registration rollers 44 substantially spaced downstream thereof, with an optional intermediate sheet deskew buckle chamber area therebetween, then first CVT rolls 46, then an imaging station 16 with the platen overlying sheet holddown CVT roller 47, then third CVT rolls 48, and then (after passing a pivotal gate 49) reversible exit nip rolls 50 at the entrance to the output tray 22. Note that the latter sheet path drive rollers (46, 47, 48, and 50) are illustrated as all driven by the motor M2, which is preferably a servo-motor for controlled driving of these rolls and particularly to provide the accurate constant velocity desired for imaging.

Turning now to the exemplary output and duplex document handling system, a gate 49 is located at the downstream end of the U-shaped document path 24, just upstream of the reversible exit nip rolls 50 and at the entrance of the duplex document path 27. The gate 49 does not obstruct documents coming from the imaging station 16, irrespective of whether they are duplex or simplex documents. All documents here go directly past the imaging station 16 into the nip of the exit rolls 50. Simplex documents are fed on by these rolls 50 and idlers 53 without any reversal thereof out into the exit tray 22 for restacking there in proper collated page order. These documents stack face down in 1 to N order, if the documents were fed face up in 1 to N order from the input tray 20 and were inverted once in the U-shaped document path 24.

However, for duplex documents which have been imaged on their first side and are yet to be imaged on their second side, as soon as the trail edge of the duplex document passes the sensor 34, the controller 100 directs the reversal of the exit rolls 50. The duplex document sheet at that point is extending substantially (for most of its length) out into the above-described inverter chute space between the trays 20 and 22. That duplex document sheet may now be rapidly reversed (25, 26) (feeding much faster than the CVT velocity) to be drawn back into the document handler toward the gate 49 by reversing rollers 50 at that point. The gate 49 is either solenoid or cam actuated or gravity loaded at this point into a position in which, as shown in phantom, the reversed duplex document is directed up into the duplex path 27. This duplex path 27 forms a return path of the duplex documents into the entrance of the U-shaped path 24, as previously noted.

Figure 2:
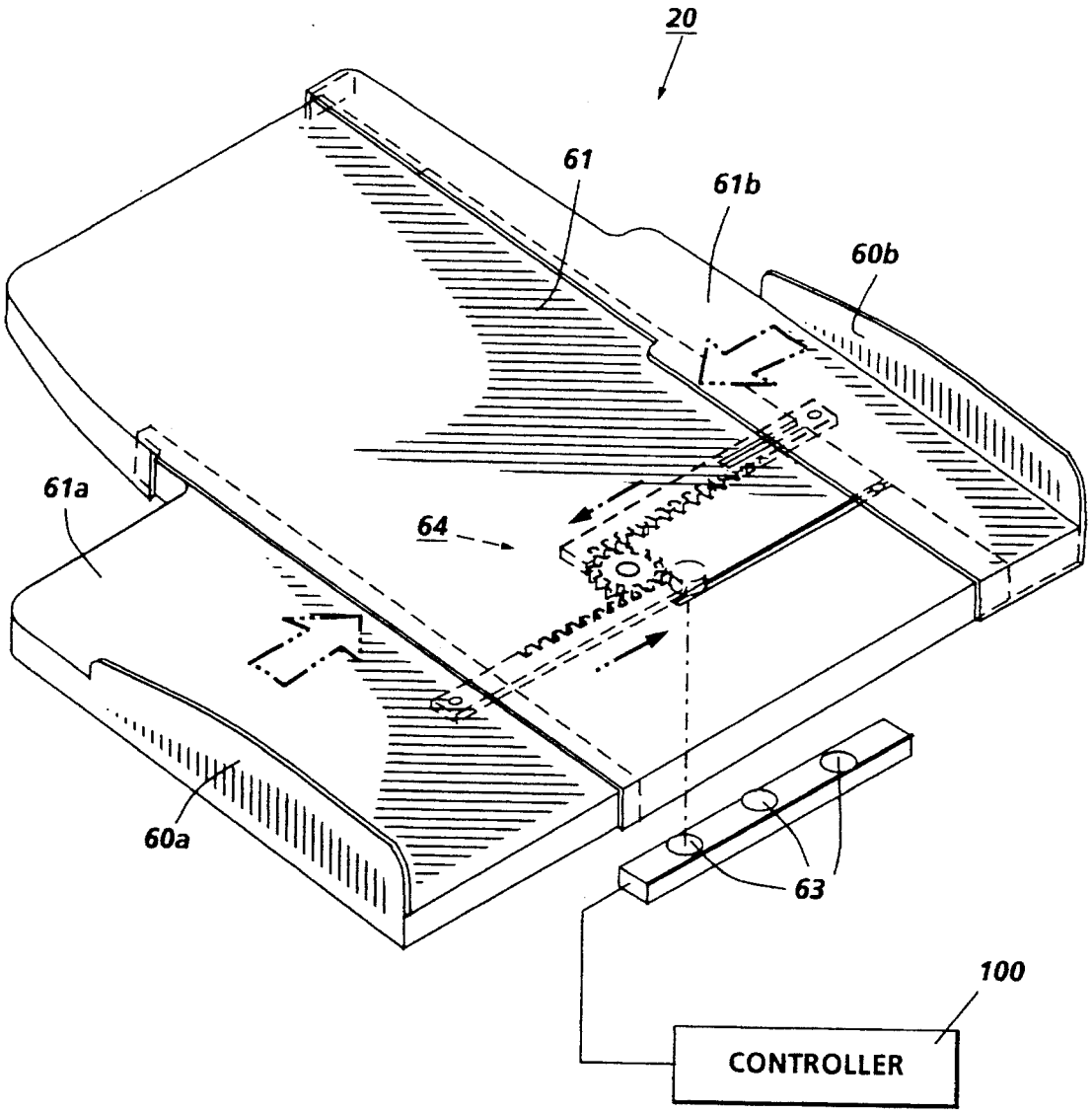
FIG. 2 is a top perspective view of the document input tray per se of the system of FIG. 1, positioned for loading a stack of large documents.
Figure 3:
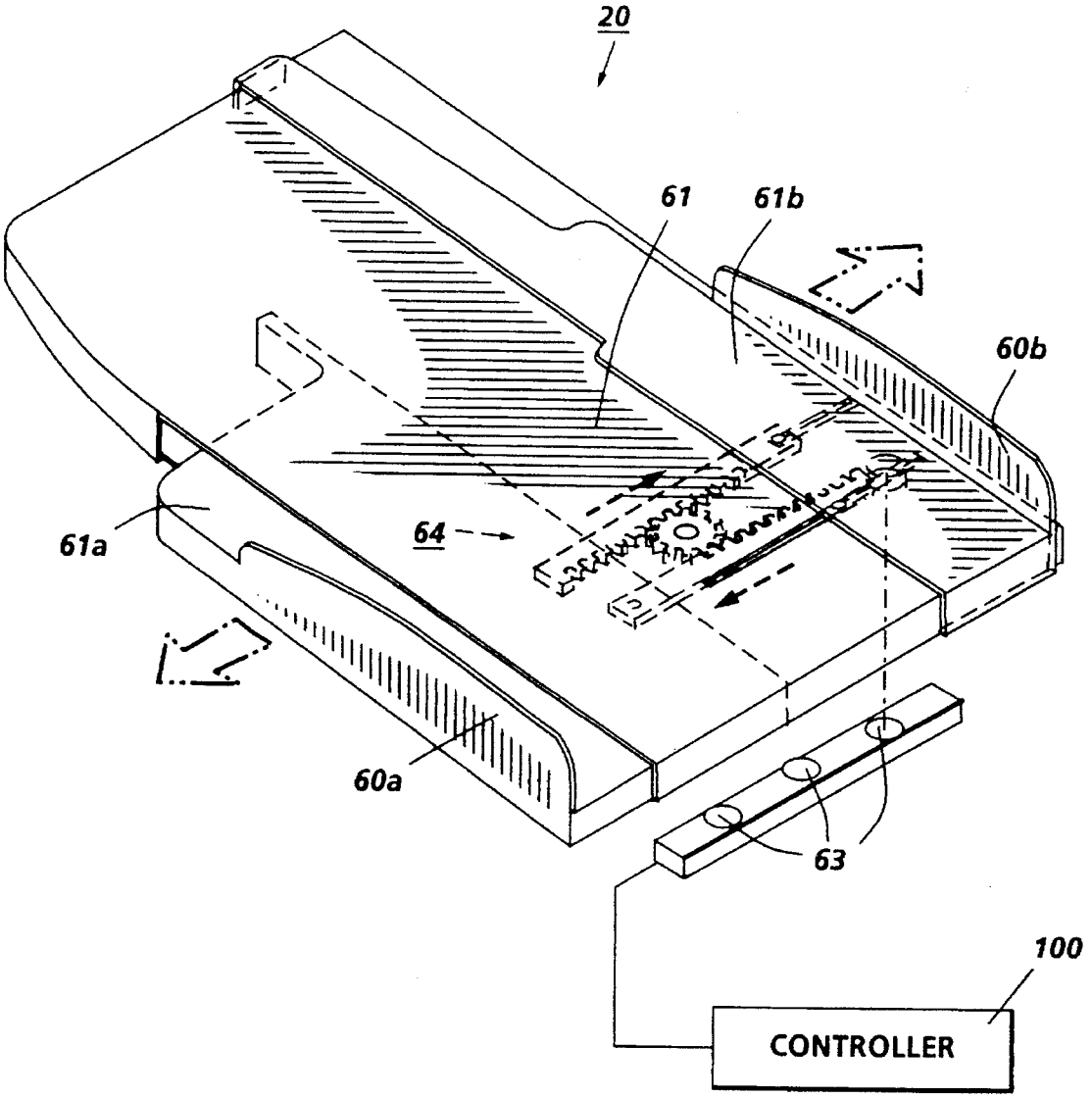
FIG. 3 is the same view of the embodiment of FIG. 2, repositioned for loading a stack of small documents.

Referring particularly to FIGS. 2 and 3, center registration and feeding of all documents from tray 20 can be conventionally provided by a well-known dual rack and pinion connection 64 of the opposing and upstanding side-guides 60*a*, 60*b* of the document input tray 20, so that the side guides 60*a*, 60*b* automatically move together towards or away from one another by the same amount, so as to center the document stack irrespective of the size of the loaded documents.

As per art cited below, known spaced plural sensor 63 or switches may be provided to detect the side guides 60*a*, 60*b* setting and thus may in a known manner indicate to controller 100 the lateral dimensions of the document sheet being stacked in tray 20. These in-tray sensors may be optional additional features, but can desirably provide combined input sheet size information with the other size information provided.

Figure 4:
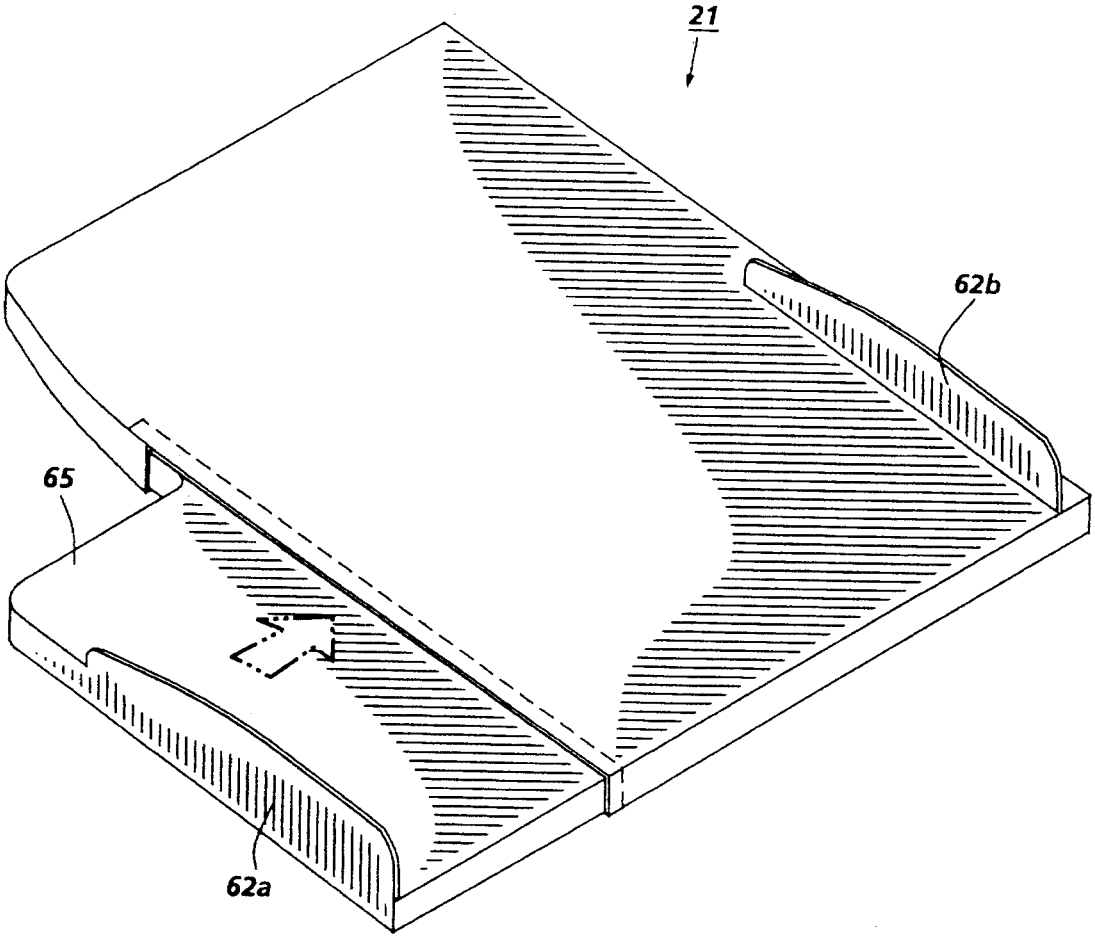
FIG. 4 is a top perspective view of an alternative embodiment variable document tray, for rear edge registering documents, shown set for receiving a stack of large documents.
Figure 5:
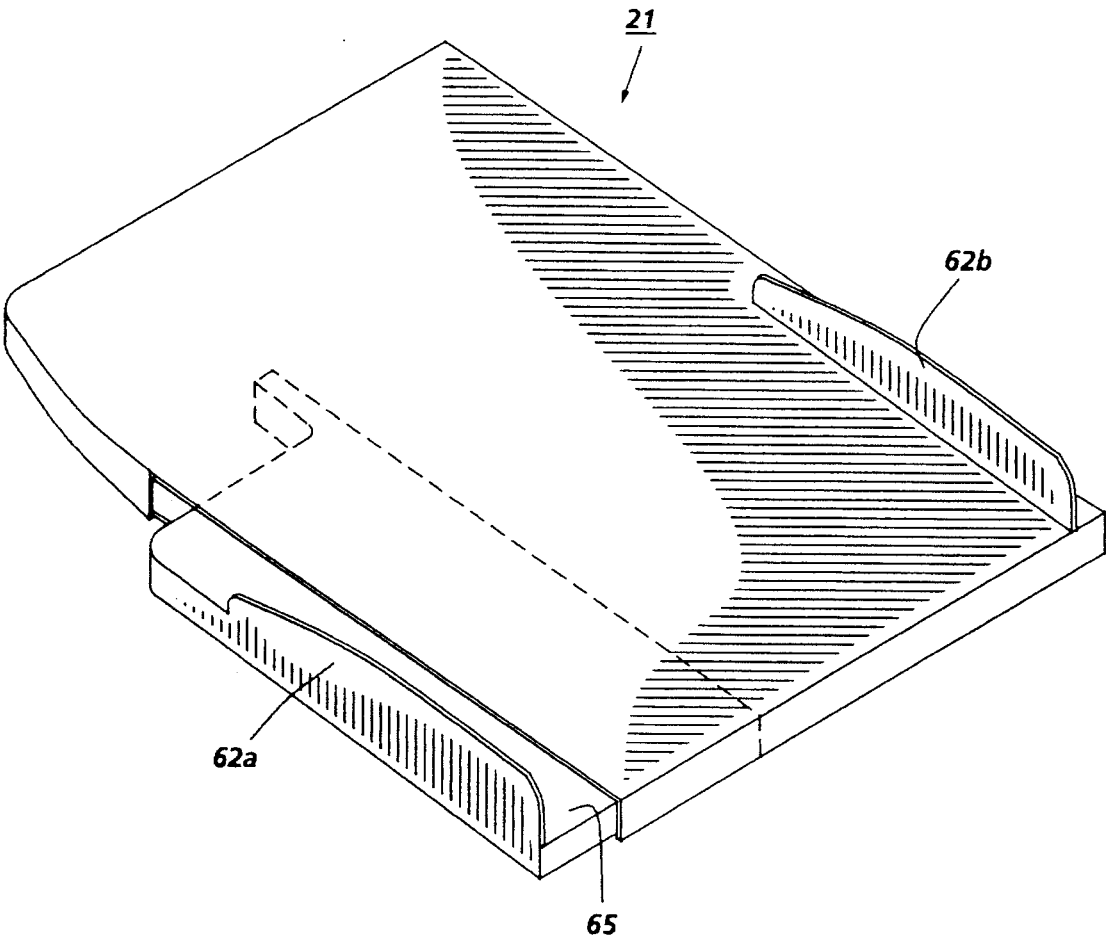
FIG. 5 is the same view of the embodiment of FIG. 4, shown reset for smaller documents.
Figure 6:
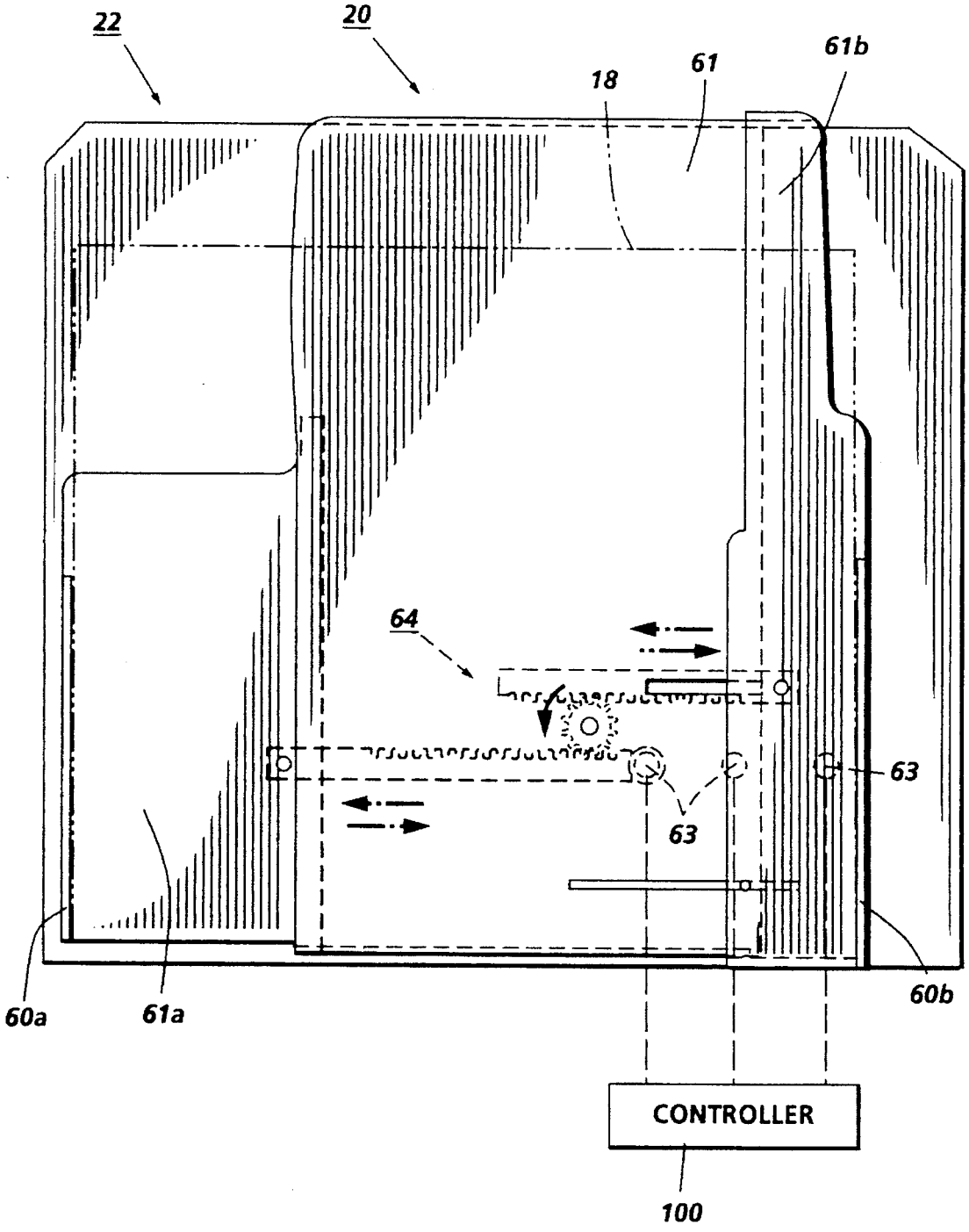
FIG. 6 is a top view of the embodiment of FIG. 1.

In the alternative rear edge registration document input tray 21 embodiment of FIGS. 4 and 5, the side guides are 62*a* and 62*b*. Here, only side guide 62*a* is movable, and it may actuate sensors or switches in the same manner.

Examples of prior art systems to measure (sense) input tray side guide settings, and to use that measurement to estimate the other (orthogonal) dimension of the documents in a known manner from a look-up table stored in memory of standard sizes of sheet, include Xerox Corporation U.S. Pat. Nos. 4,579,444, 4,745,438 (e.g. Col. 11), 3,689,143, and 4,351,606 and 5,333,852; also U.S. Pat. Nos. 4,277,163 and 4,406,537 of others. Also noted is a Xerox Disclosure Journal Publication Vol. 11, No. 2, p. 89, dated March/April 1986, by William A. Henry, II.

Turning now to novel features of the disclosed embodiments, it may be seen that the input tray system 20 of FIGS. 1–3 has variable area generally horizontal and substantially planar stack supporting surface 61. Each side of this supporting surface 61 here comprises a telescoping surface member 61*a* and 61*b* each mounting, respectively, one side guide 60*a* and 60*b* closely adjacent its outer edge, resettable therewith. Here, there are two opposing such telescoping surface members 61*a* and 61*b*, for center registration. FIG. 2 shows its minimum area and FIG. 3 its maximum or extended area.

In the rear registration document input tray system 21 of FIGS. 4 and 5 (also shown open and closed, respectively) a similar but single telescoping member 65 may be used, with the side guide 62*a* extending up from its outer edge. As the movable side guide 62*a* is moved in towards the fixed rear side guide 62*b*, the tray 21 document supporting or horizontal area shrinks automatically, by member 65 telescoping into the rest of the tray supporting surface, i.e. into the stationary central mounting portion of the tray 21.

The disclosed variable width input tray system may thus be utilized with either edge registered or center registered document handling systems, with appropriate designs for each, such as 21 or 20, respectively. In an edge registered system as in the example of FIGS. 4 and 5, as noted, one side guide 62*b* of the tray 21 may be fixed, and only the other side guide 62*a* is moved, for stack registration, towards or away from this fixed side guide 62*b*, to accommodate the different size of documents being loaded. The tray horizontal dimensions automatically also change in that same direction, by moving therewith. If the side registration is to the rear of the machine, as shown in FIGS. 4 and 5, the outboard or closest to the operator side portion 65 of the input tray will be slideable inboard or outboard to adjust to the loaded paper width, and this slide incorporates the movable edge guide 62*a*.

For a center registration system, as in FIGS. 1, 2, and 3, typically both side guides are gauged to move together by an interconnection, commonly a center pinion and dual rack interconnection, as shown here in phantom at 64, so as to maintain centering of the document sheets irrespective of their width relative to the document handler. In this center registration case, the present system reduces the width of the overlying document input tray 20 here at both sides thereof as the loaded document size is reduced.

In either case, the upper document tray 20 or 21 may be set to a varying width which is only slightly wider than the widest document loaded to be fed, so that, unlike other document handler trays, there is not a large lateral overhang of the top tray over the documents in the underlying tray, particularly for narrow documents and/or documents being fed short edge first. Unlike conventional trays which have a normal fixed width, and therefore constant overlay, of at least 11 or 14 inches, for supporting documents of those standard letter or legal size paper dimensions, the upper tray here may be shrunk to only 8½ inches or even 5 inches in width for documents with those standard widths loaded into the input tray.

While the embodiments disclosed herein are preferred, it will be appreciated from this teaching that various alternatives, modifications, variations or improvements therein may be made by those skilled in the art, which are intended to be encompassed by the following claims:

What is claimed is:

1. A document handling system with an imaging station, a document output tray, and a document input tray overlying said document output tray, said document input tray being adapted to supportably stack therein for feeding multiple document sheets of varying sizes for sequentially feeding the document sheets from the stack of document sheets to said imaging station, which document sheets are then fed from said imaging station to said document output tray under said document input tray, wherein said document input tray has a resettable stack registration side guide system with upstanding opposing document edge guides resetably conformable to the lateral dimensions of said stack of document sheets loaded in said document input tray by movement of at least one said edge guide towards or away from the other; said document input tray further comprising a substantially planer document stack supporting tray surface with a lateral area for fully supporting the stack of document sheets in said document input tray between said upstanding opposing document edge guides, and wherein said document input tray document stack supporting tray surface comprises at least two mutually telescoping portions which automatically telescope within one another to vary said lateral area of said document stack supporting tray surface upon said resetting of said resettable side guide system to conform to the lateral dimensions of a stack of documents loaded into said document input tray, and wherein the lateral area of said document input tray stack supporting tray surface is defined by the opposing outer lateral edges of said telescoping portions, and at least one said outer lateral edge automatically moves toward said other outer lateral edge as said document edge guides are moved towards one another, so that the lateral dimensions of said overlying document input tray automatically shrink for smaller documents to reduce the obstruction of, and improve the view of, and access to, said underlying document output tray.

* * * * *